US007291096B2

(12) United States Patent
Ho et al.

(10) Patent No.: US 7,291,096 B2
(45) Date of Patent: Nov. 6, 2007

(54) AMPHIBIOUS FOLDABLE TREADMILL

(75) Inventors: Helen Ho, Taichung (TW); Diana Ho, No. 47, Lane 59, Nan-Men Road, Taichung (TW) 402

(73) Assignee: Diana Ho, Taichung (TW)

( * ) Notice: Subject to any disclaimer, the term of this patent is extended or adjusted under 35 U.S.C. 154(b) by 266 days.

(21) Appl. No.: 11/182,044

(22) Filed: Jul. 15, 2005

(65) Prior Publication Data

US 2007/0015634 A1 Jan. 18, 2007

(51) Int. Cl.
*A63B 22/02* (2006.01)

(52) U.S. Cl. ..... 482/54; 482/53

(58) Field of Classification Search ..... 482/51–56
See application file for complete search history.

(56) References Cited

U.S. PATENT DOCUMENTS 5,123,641 A * 6/1992 Abboudi et al. ..... 482/54
6,077,200 A * 6/2000 Lin ..... 482/54
6,494,814 B1 * 12/2002 Wang et al. ..... 482/54
6,533,707 B2 * 3/2003 Wang et al. ..... 482/54
6,602,167 B2 * 8/2003 Chen ..... 482/54

* cited by examiner

*Primary Examiner*—Jerome Donnelly
*Assistant Examiner*—Tam Nguyen

(57) ABSTRACT

An amphibious foldable treadmill includes: a main frame having at least a wheel rotatably mounted on a base of the main frame to be rolled on a ground floor or on a pool bottom, a tread belt device pivotally secured to the main frame and unfolded from the main frame to be laid on the floor or pool bottom for treading operation, and a hand rail device pivotally secured to the main frame and pivotally connected with the tread belt device, whereby upon folding of the hand rail device and the tread belt device to the main frame, the treadmill can be folded for convenient handling, moving, launching in a pool or landing on the ground floor from the pool for successfully serving as an amphibious treadmill.

6 Claims, 4 Drawing Sheets

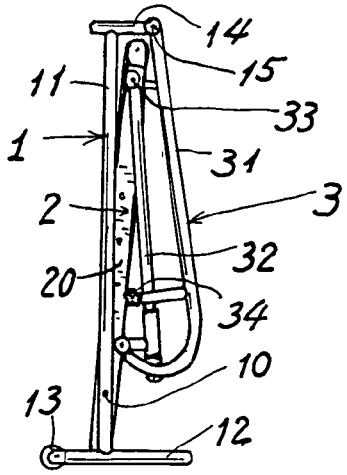
Fig. 7
Fig. 8
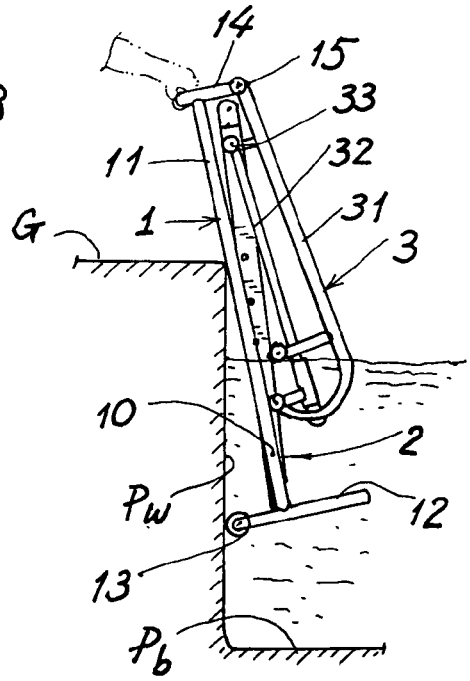
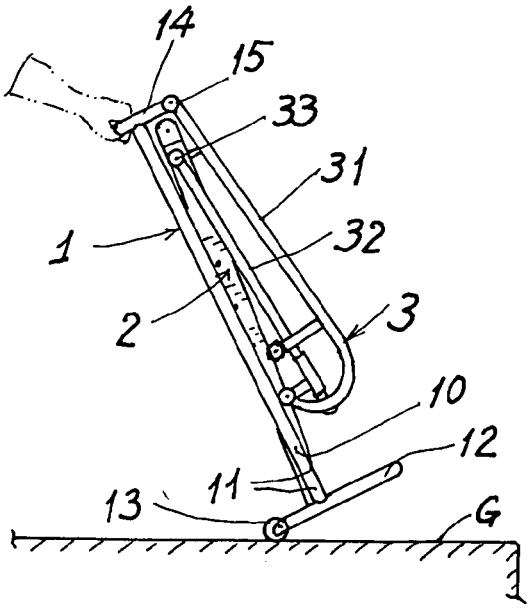
Fig. 9

AMPHIBIOUS FOLDABLE TREADMILL

BACKGROUND OF THE INVENTION

U.S. Pat. No. 5,921,892 to Richard L. Easton disclosed an underwater treadmill device adapted to be used for underwater exercise. However, such an underwater treadmill device is formed as a fixed type treadmill, being unable for folding or unfolding operation. It is therefore inconvenient for handling or moving such a fixed treadmill.

The present inventor has found the drawback of the prior art and invented the present amphibious foldable treadmill.

SUMMARY OF THE INVENTION

The object of the present invention is to provide an amphibious foldable treadmill including: a main frame having at least a wheel rotatably mounted on a base of the main frame to be rolled on a ground floor or on a pool bottom, a tread belt device pivotally secured to the main frame and unfolded from the main frame to be laid on the floor or pool bottom for treading operation, and a hand rail device pivotally secured to the main frame and pivotally connected with the tread belt device, whereby upon folding of the hand rail device and the tread belt device to the main frame, the treadmill can be folded for convenient handling, moving, launching in a pool or landing on the ground floor from the pool for successfully serving as an amphibious treadmill.

BRIEF DESCRIPTION OF THE DRAWINGS

FIG. 7 shows the folded treadmill of the present invention.

FIG. 8 shows the launching of the treadmill into a pool in accordance with the present invention.

FIG. 9 shows a pushing (or pulling) operation of the present invention as rolled on a ground floor.

DETAILED DESCRIPTION

Figure 1:
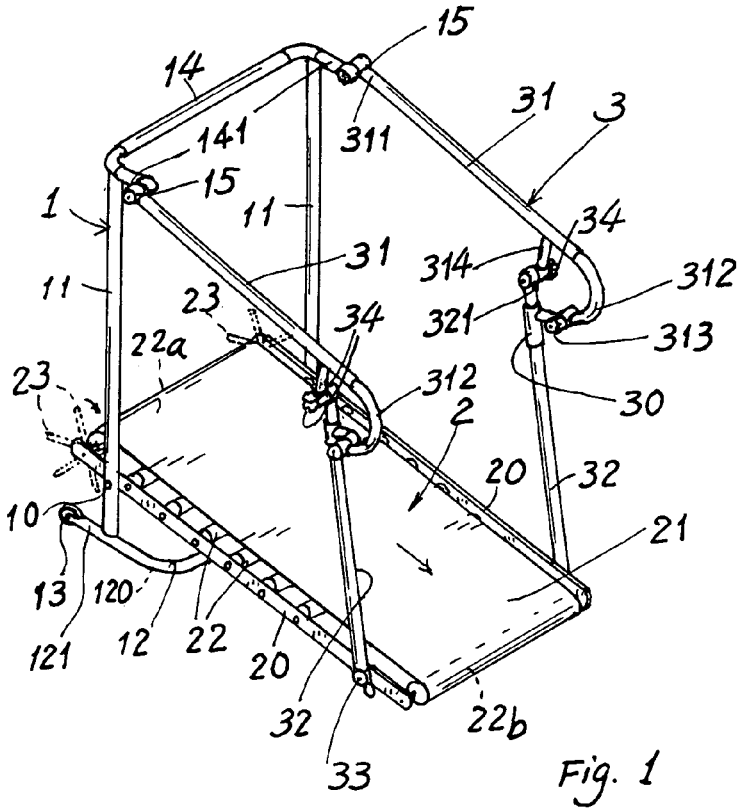
FIG. 1 is a perspective view of the present invention.

As shown in the drawing figures, the present invention comprises: a main frame 1, a tread belt device 2 pivotally secured to the main frame 1, and a hand rail device 3 pivotally secured between the main frame 1 and the tread belt device 2.

The main frame 1 includes: a pair of columns 11 normally parallelly erected vertically, a base 12 formed on a bottom of the columns 11 having a flat bottom surface 120 of the base stably rested or laid on a ground floor surface or a pool bottom surface Pb, a pair of wheels 13 rotatably mounted on the base 12, and a handle 14 formed on an upper portion of the columns 11 to be pushed or pulled by a user of the treadmill.

Figure 3:
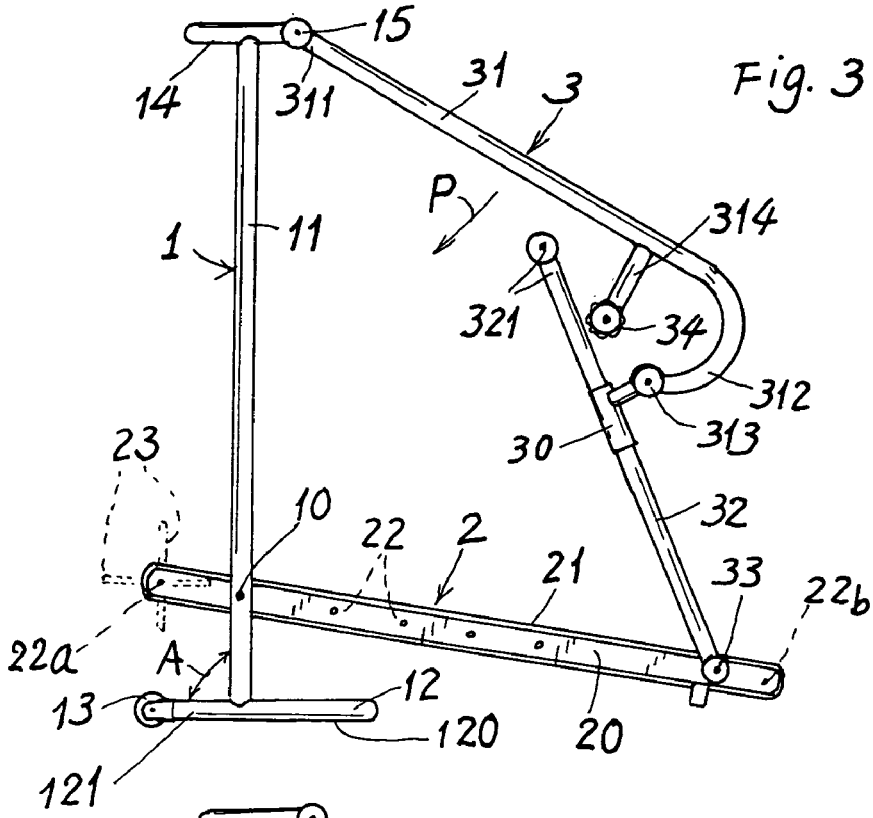
FIG. 3 is an illustration showing an initial step for folding the present invention.

The base 12 may be formed as a U-shaped bar 12 to be projectively perpendicular to each said column 11, having the pair of wheels 13 rotatably secured to a pair of leg members 121 protruding forwardly from the base 12, with each leg member 121 generally defining an acute angle or right angle A between each leg member 121 and each column 11 (FIG. 3).

The handle 14 may also be formed as a U-shaped bar or rod member having a pair of arm members 141 protruding rearwardly from the U-shaped bar member to be pivotally secured with the hand rail device 3.

The main frame 1 and the hand rail device 3 may be made of stainless steel, aluminum alloy or any other suitable materials, not limited in the present invention. However, they should be resistant to water corrosion as submerged in a pool or underwater.

The tread belt device 2 includes: an endless belt 21 wound about a plurality of rollers 22 juxtapositionally rotatably secured to a belt frame 20, having a front-end roller 22*a* and a rear-end roller 22*b* respectively disposed on opposite ends of the belt 21, and having a front portion of the belt frame 20 pivotally secured to a lower portion of each column 11 of the main frame 1 by a belt pivot 10.

The raw materials for making the elements of the tread belt device 2 are not limited in this invention, but they should also be water resistant.

Figure 2:
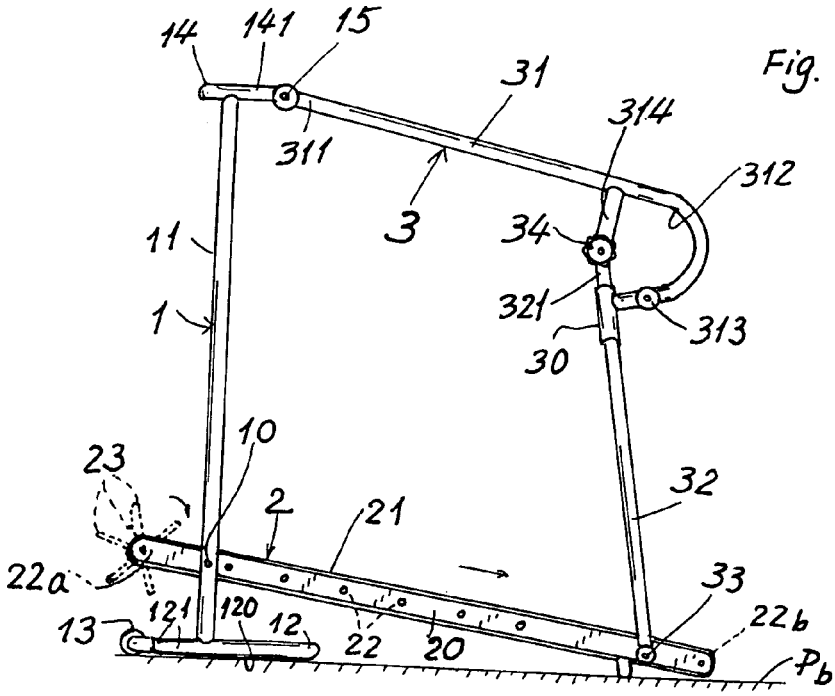
FIG. 2 is a side view of the treadmill of the present invention.

In order to enrich the exercising interest and increasing the treading load for the user when treading on the belt 21 underwater, at least a pair of impellers 23 may be secured on opposite end portions of a roller such as the front-end roller 22*a* as shown in FIGS. 1~3.

However, such an impeller 23 may also be eliminated for simplifying the production and decreasing the cost.

The hand rail device 3 includes: a pair of hand rails 31 each hand rail 31 having a front portion 311 pivotally secured to each arm member 141 of the handle 14 by a rail pivot 15, and a pair of supporting bars 32 each supporting bar 32 having a lower bar portion pivotally secured to a rear portion of the tread belt device 2 by a belt pivot 33, each hand rail 31 having an arcuate portion 312 formed on a rear portion of the hand rail 31 to be pivotally connected with a sleeve member 30 by a sleeve pivot 313, with the sleeve member 30 slidably engaging with each supporting bar 32, and each supporting bar 32 having a locking end portion 321 detachably fastened to a protruding portion 314 of each hand rail 31 by a locking bolt 34 when assembling the treadmill of the present invention.

When each locking bolt 34 is actuated to lock each hand rail 31 on each supporting bar 32 as shown in FIGS. 1, 2, the user (who may be a hydrotherapeutic patient) may tread on the belt 21 for exercising or hydrotherapy.

Since the treadmill is submerged in a pool, the patient, even unable to swim, may exercise himself or herself safely and comfortably in the soft water environment and under buoyancy.

If the impellers 23 are provided on the treadmill, they may enhance the exercising interest and also increase the "load" to be trodden by the patient on the belt 21, thereby giving an efficient exercising or training measure especially beneficial for a hydrotherapy patient.

Figure 4:
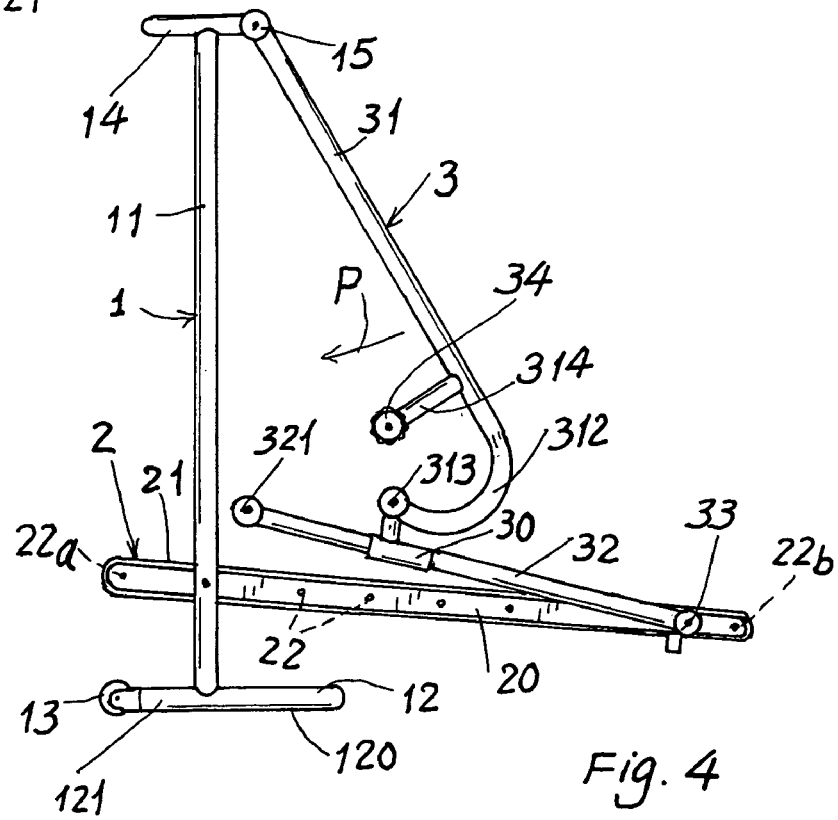
FIG. 4 shows a next folding step of the present invention following FIG. 3.

When not in use, the locking bolt 34 is unlocked to detach the hand rail 31 from the supporting bar 32 as shown in FIG. 3. The hand rail 31 is then biased or pressed (P) downwardly about the pivot 15 from FIG. 3 to FIG. 4 to fold the hand rails 31 towards the main frame 1.

Figure 5:
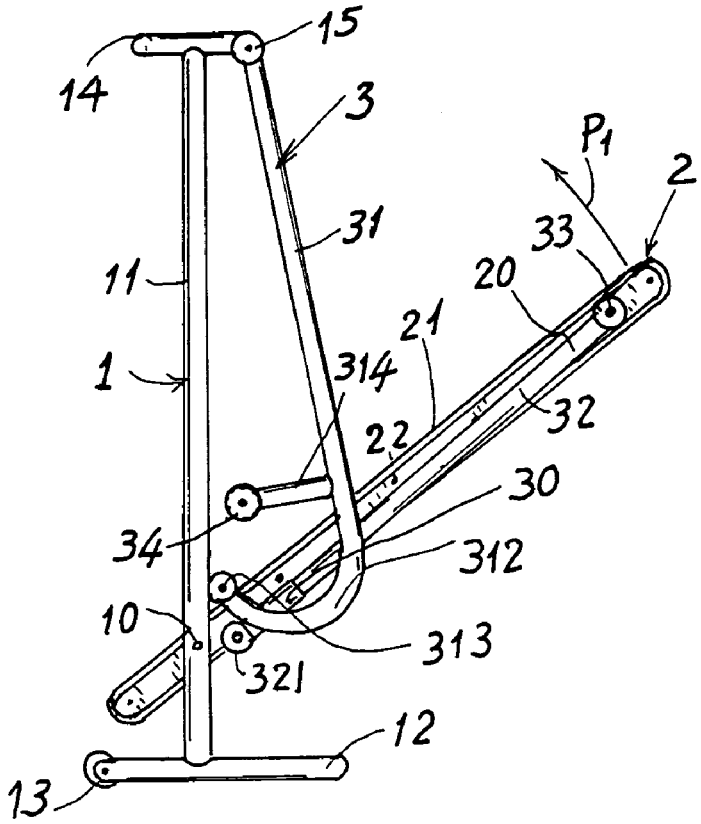
FIG. 5 shows a further folding step following FIG. 4.
Figure 6:
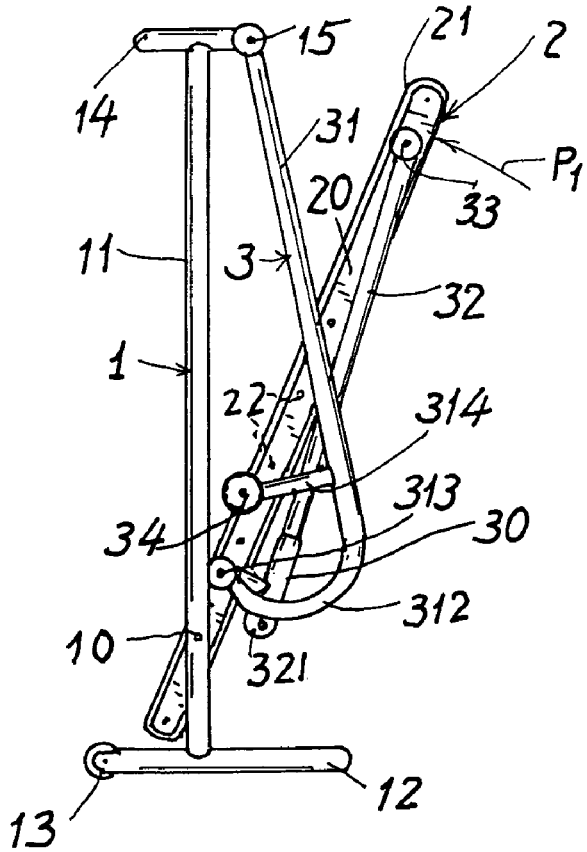
FIG. 6 shows the folding step after that as shown in FIG. 5.

Meanwhile, the tread belt device 2 is biased or folded ($P_1$) towards the main frame 1 about the pivot 10 from FIG. 5 to FIG. 6, until folding the hand rail device 3 and the tread belt device 2 to be close to the main frame 1 as shown in FIG. 7.

The complete set of treadmill of the present invention may then be pulled to "land" on a ground surface G by rolling the wheels 13 on the pool wall Pw as shown in FIG. 8. It is easily operated for moving the treadmill from the pool to a ground surface without scratching or damaging the pool since the leg members 121 having wheels 13 rotatably secured thereon are protruded forwardly from the base 12 to be generally perpendicular to the columns 11 to merely allow the wheels 13 to be rolled on the pool wall Pw.

The treadmill is also easily and conveniently moved by pushing or pulling the treadmill since the user may grasp the handle 14 of the main frame 1 to push or pull it ergonomically (FIG. 9).

So, it can be folded to greatly minimize the volume to be easily carried or handled by a car, being very convenient for the user or for a hydrotherapeutist who may bring this treadmill from his office to the pool or gym.

The present invention is amphibious because it can be handled or operated on a land or in a pool (underwater). For handling or transportation, it can be folded to reduce its volume. For use, it may then be quickly unfolded ready for service. By grasping the handle 14 of the main frame 1, the treadmill may be safely smoothly launched into a pool by sliding the columns 11 along the corner of the pool wall and by rolling the wheels 13 on the pool wall Pw. Therefore, the treadmill can be safely conveniently launched underwater especially provided for hydrotherapy use. Then, it may be quickly unfolded, just by laying the belt device 2 on the pool bottom Pb, by raising the hand rails 31 and erecting the supporting bars 32 and finally fastening the locking bolts 34 to stably assemble the treadmill for treading use.

The present invention is superior to the prior art because it can be quickly conveniently folded or unfolded and can be used either on a land or in a pool (underwater). So, it is really amphibious.

The present invention may be modified without departing from the spirit and scope of the present invention. For instance, a plurality of rollers (not shown) may be further mounted on the columns 11 (or plastic or rubber coating provided on the columns) to prevent from scratching or damage to the pool wall, not limited in this invention.

We claim:

1. An amphibious foldable treadmill comprising:

a main frame having at least a pair of wheels rotatably mounted on a bottom of said main frame to be rolled on a ground surface to allow for treading on any land surface or to be rolled on a pool wall for launching into a pool for underwater treading;

a tread belt device, having an endless belt, pivotally secured to said main frame; and a hand rail device pivotally secured between said main frame and said tread belt device;

whereby upon folding of said tread belt device and said hand rail device towards said main frame, a folded treadmill is obtained for easy moving, handling, landing on a ground or launching into water; said hand rail device including: a pair of hand rails respectively pivotally secured to a pair of arm members of a U-shaped handle of said main frame, and a pair of supporting bars with each supporting bar having a lower bar portion pivotally secured to a rear portion of the tread belt device, each said hand rail having an arcuate portion formed on a rear portion of the hand rail to be pivotally connected with a sleeve member, with the sleeve member slidably engaging with each said supporting bar, and each said supporting bar having a locking end portion detachably fastened to a protruding portion of each said hand rail by a locking bolt when assembling the treadmill.

2. A treadmill according to claim 1, where said main frame includes: a pair of columns normally erected in parallel vertically, a base formed on a bottom of said columns having a flat bottom surface of said base stably rested on a ground floor surface or a pool bottom surface, said pair of wheels rotatably mounted on the base, and a handle formed on an upper portion of said columns to be pushed or pulled by a user of the treadmill.

3. A treadmill according to claim 2, where said base is formed as a U-shaped bar to be projectively perpendicular to said column, having the pair of wheels rotatably secured to a pair of leg members protruding forwardly from the base, with each said leg member defining an acute angle between each said leg member and each said column.

4. A treadmill according to claim 2, where said handle is formed as a U-shaped bar member having a pair of arm members protruding rearwardly from the U-shaped bar member to be pivotally secured with the hand rail device.

5. A treadmill according to claim 1, where said tread belt device includes: a plurality of rollers, around which the endless belt is wound, juxtapositionally rotatably secured to a belt frame, a front-end roller and a rear-end roller of said rollers respectively disposed on opposite ends of the belt frame, and having a front portion of the belt frame pivotally secured to a lower portion of each column of a pair of columns of the main frame.

6. A treadmill according to claim 5, where said tread belt device includes at least a pair of impellers secured on opposite end portions of one said roller rotatably mounted on said belt frame.

* * * * *